US011275321B2

(12) United States Patent
Fukushima et al.

(10) Patent No.: US 11,275,321 B2
(45) Date of Patent: Mar. 15, 2022

(54) IMAGE FORMING APPARATUS COMPRISING LEAKAGE DETECTION

(71) Applicant: CANON KABUSHIKI KAISHA, Tokyo (JP)

(72) Inventors: Naoki Fukushima, Shizuoka (JP); Shunsuke Matsushita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/189,578

(22) Filed: Mar. 2, 2021

(65) Prior Publication Data

US 2021/0278777 A1 Sep. 9, 2021

(30) Foreign Application Priority Data

Mar. 3, 2020 (JP) ..... JP2020-035465

(51) Int. Cl.
*G03G 15/02* (2006.01)

(52) U.S. Cl.
CPC ..... *G03G 15/0266* (2013.01)

(58) Field of Classification Search
CPC ..... G03G 15/0266; G03G 15/0283; G03G 15/065; G03G 15/1665
See application file for complete search history.

(56) References Cited

U.S. PATENT DOCUMENTS 10,025,218 B2 * 7/2018 Nakajima ..... H04N 1/00899
10,890,855 B2 * 1/2021 Shiraki ..... G06K 15/12
10,921,728 B2 * 2/2021 Okubo ..... G03G 15/047
2016/0202643 A1 * 7/2016 Nakajima ..... G03G 15/80 399/9
2017/0322502 A1 * 11/2017 Kidaka ..... G03G 15/04018

FOREIGN PATENT DOCUMENTS

JP 2005-078015 A 3/2005
JP 2013-221994 A 10/2013
JP 2014-059471 A 4/2014
JP 2015-075729 A 4/2015

* cited by examiner

*Primary Examiner* — Arlene Heredia
(74) *Attorney, Agent, or Firm* — Venable LLP

(57) ABSTRACT

An image forming apparatus includes a rotatable image bearing member, a charging member, a charging voltage applying portion, a developer carrying member, a developing voltage applying portion, a detecting portion, and a controller. In a state in which the charging voltage is applied to the charging member, the controller controls the detecting portion so as to detect whether or not a change amount between a current value detected by the detecting portion when the surface of the image bearing member opposing the developer carrying member before application of the developing voltage passes through an opposing portion where the charging member and the image bearing member are opposed to each other and a current value detected by the detecting portion when the surface of the image bearing member opposing the developer carrying member after the application of the developing voltage passes through the opposing portion is a threshold or more.

9 Claims, 6 Drawing Sheets

IMAGE FORMING APPARATUS COMPRISING LEAKAGE DETECTION

FIELD OF THE INVENTION AND RELATED ART

The present invention relates to an image forming apparatus for forming an image on a recording medium by using an electrophotographic type process.

In the image forming apparatus, such as a printer, using the electrophotographic type (electrophotographic) process in order to develop an electrostatic latent image formed on an image bearing member, various developing devices have been used. As an example of a type of the developing devices, a non-contact developing type in which the image bearing member and a developer carrying member opposing the image bearing member are provided with a predetermined interval (gap) has been known.

In the non-contact developing type, a superposed developing bias (voltage) in a combination form of a DC voltage and an AC voltage is applied to the developer carrying member, so that charged toner moves (flies) from the developer carrying member to the image bearing member, and the electrostatic latent image formed on the image bearing member is developed into a toner image. The toner image formed on the image bearing member is transferred and fixed on a recording medium such as a sheet.

Incidentally, in the non-contact developing type, the image bearing member and the developer carrying member are driven, so that the gap formed between the image bearing member and the developer carrying member fluctuates in some cases. By the fluctuation of the gap, an electric field strength between the image bearing member and the developer carrying member fluctuates, so that there was a problem such that density non-uniformity of an image formed occured .

In order to solve this problem, by increasing a peak-to-peak voltage (peak-to-peak value) of the AC voltage of the developing voltage, the toner sufficiently moves from the developer carrying member to the image bearing member, so that it is possible to suppress an occurrence of the image density non-uniformity. However, when the peak-to-peak voltage of the AC voltage of the developing voltage is increased, a potential difference between itself and a surface potential of the image bearing member becomes large, and then leakage occurs between the developer carrying member and the image bearing member, so that there was a problem such that noise generates on the image to be formed.

The peak-to-peak voltage of the AC voltage at which the leakage occurs changes depending on the gap, atmospheric pressure and the like, and therefore, the peak-to-peak voltage changes depending on a change in individual image forming apparatus and an operation (use) environment.

For that reason, in Japanese Laid-Open Patent Application (JP-A) 2005-78015, the peak-to-peak voltage (peak-to-peak value) of the AC voltage of the developing voltage applied between the image bearing member and the developer carrying member is gradually increased from a value at which the leakage does not occur. Then, impedance is measured on the basis of a current value of a current flowing between the image bearing member and the developer carrying member, so that an occurrence of the leakage is detected from a measured value of the impedance and the current value.

However, in JP-A 2005-78015, in order to detect the occurrence of the leakage between the image bearing member and the developer carrying member, there is a need to measure the impedance in advance, so that there was a problem such that a detecting time required for developing that the leakage occurs becomes long.

SUMMARY OF THE INVENTION

A principal object of the present invention is to provide an image forming apparatus capable of shortening a detection time required for detecting occurrence of leakage.

According to an aspect of the present invention, there is provided an image forming apparatus comprising: a rotatable image bearing member; a charging member configured to electrically charge a surface of the image bearing member; a charging voltage applying portion configured to apply a charging voltage to the charging member; a developer carrying member provided opposed to the image bearing member in non-contact with the image bearing member and configured to carry a developer; a developing voltage applying portion configured to apply, to the developer carrying member, a developing voltage in a combination form of a DC voltage and an AC voltage; a detecting portion configured to detect a current value of a current flowing between the image bearing member and the charging member; and a controller configured to control the detecting portion so as to detect the current value of the current, wherein in a state in which the charging voltage is applied to the charging member, the controller controls the detecting portion so as to detect whether or not a change amount between a current value detected by the detecting portion when the surface of the image bearing member opposing the developer carrying member before application of the developing voltage passes through an opposing portion where the charging member and the image bearing member oppose to each other and a current value detected by the detecting portion when the surface of the image bearing member opposing the developer carrying member after the application of the developing voltage passes through the opposing portion is a threshold or more.

Further features of the present invention will become apparent from the following description of exemplary embodiments with reference to the attached drawings.

Figure 4:
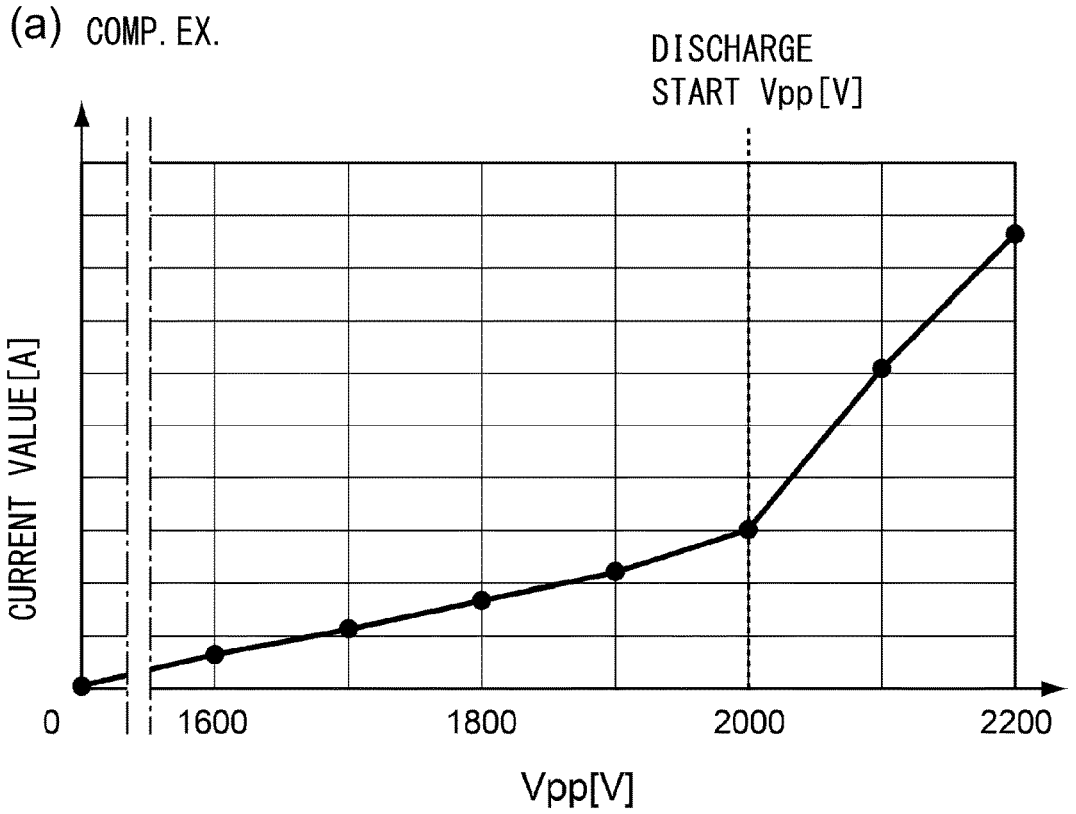
Figure 4:
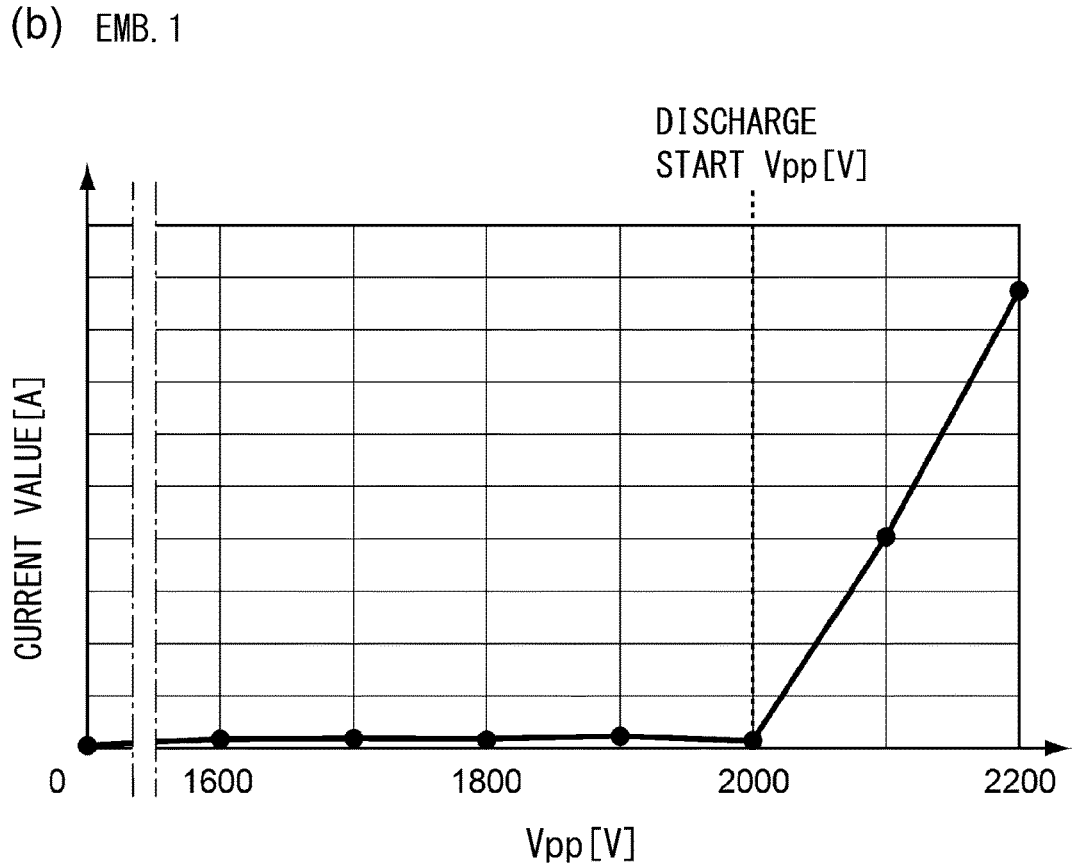

Part (a) of FIG. 4 is a relationship view of an AC voltage and a current value in a comparison example, and part (b) of FIG. 4 is a relationship view of an AC voltage and a current value in an embodiment 1.

Figure 5:
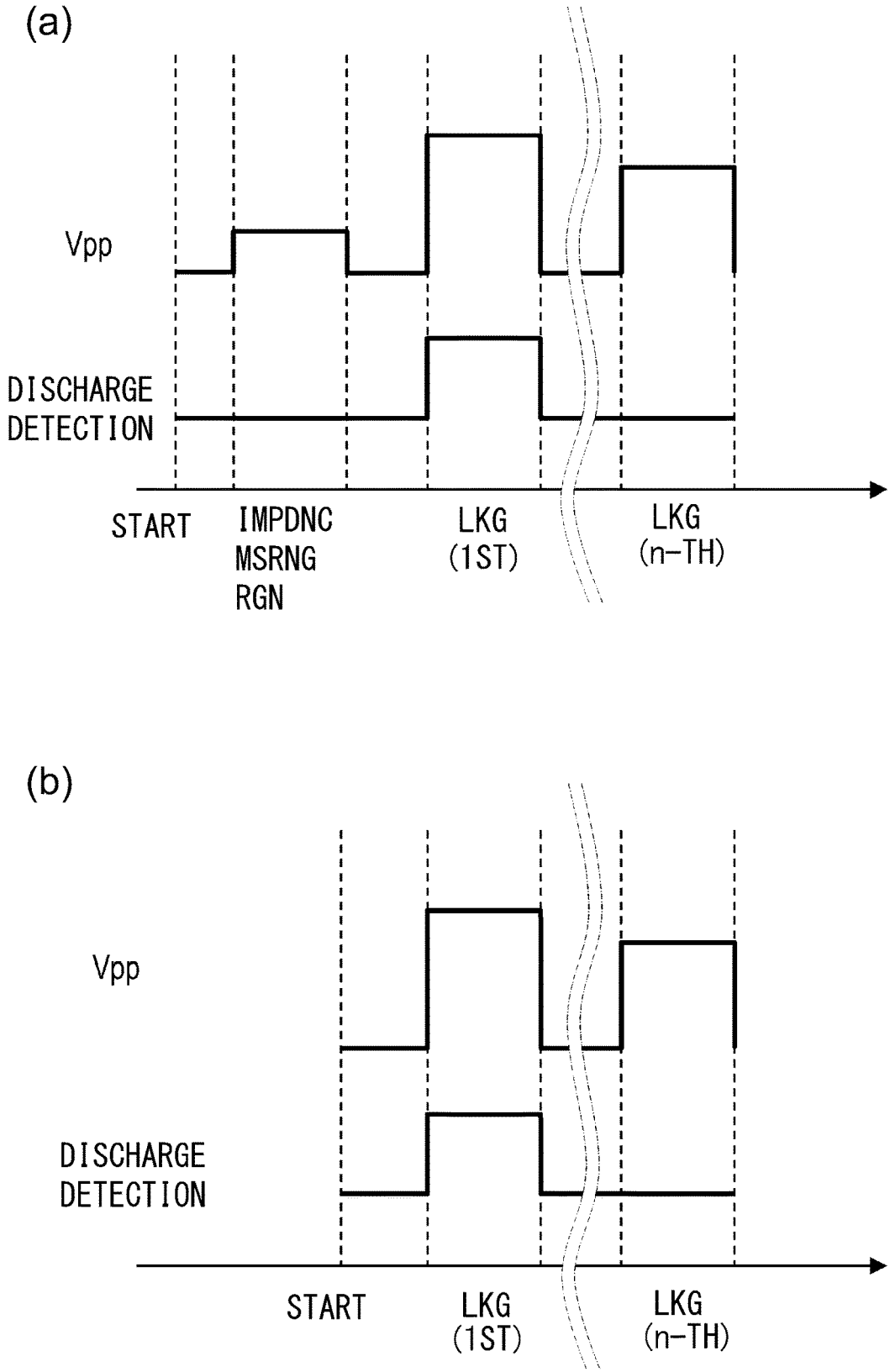

Part (a) of FIG. 5 is a timing chart of AC voltage setting during detection of an occurrence of discharge in the comparison example, and part (b) of FIG. 5 is a timing chart of AC voltage setting during detection of an occurrence of discharge in the embodiment 1.

Figure 6:
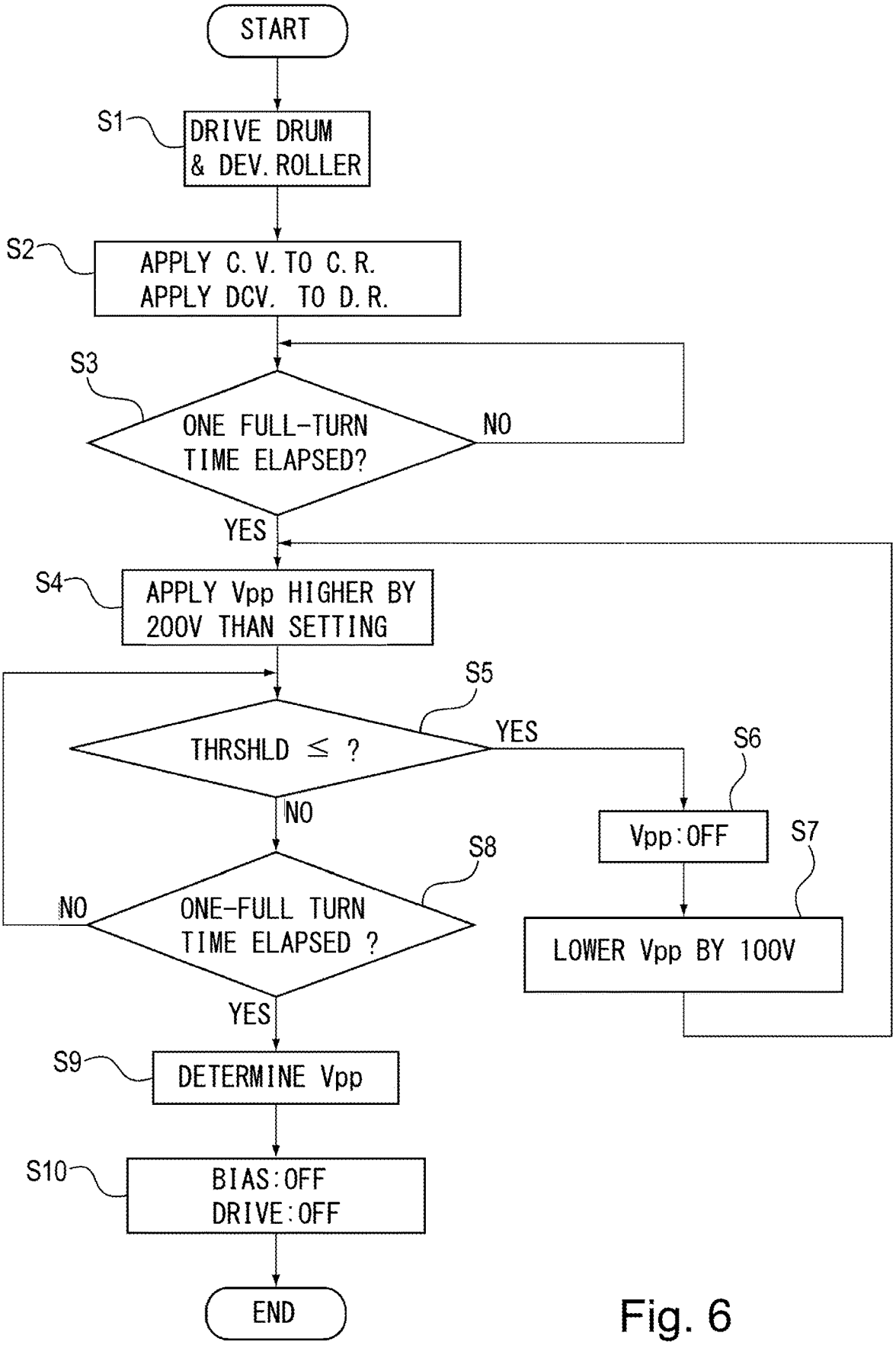

FIG. 6 is a flow chart showing discharge detection control in the embodiment 1.

DESCRIPTION OF THE EMBODIMENTS

In the following, embodiments of the present invention will be specifically described exemplarily. However, dimensions, materials, shapes, and relative arrangement of constituent elements described in the following embodiments should be appropriately changed depending on structures and various conditions of apparatuses to which the present invention is applied, and the scope of the present invention is not intended to be limited to the following embodiment.

Figure 1:
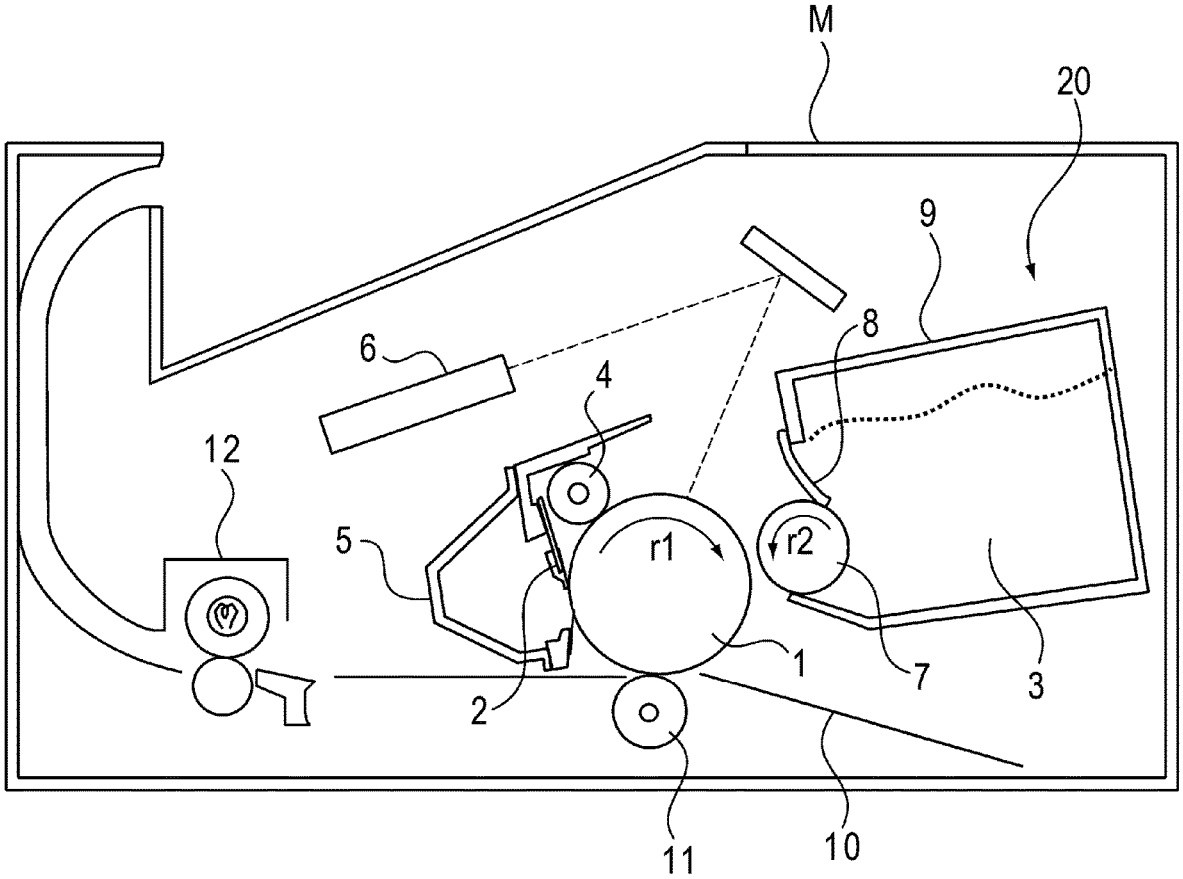
FIG. 1 is a sectional view of an image forming apparatus.

With reference to FIG. 1, a general structure of an image forming apparatus will be described together with an image forming operation. FIG. 1 is a schematic sectional view showing the general structure of the image forming apparatus according to an embodiment 1 of the present invention.

<Image Forming Apparatus>

The image forming apparatus is a laser (beam) printer using an electrophotographic type process, and a process cartridge 20 is constituted so as to be mountable to and dismountable from an apparatus main assembly M. Here, the apparatus main assembly M refers to constituent elements excluding the process cartridge 20 from the image forming apparatus. Further, the image forming apparatus to which the present invention is applicable is not limited to those described herein. For example, the present invention is also applicable to a color laser printer which includes a plurality of process cartridges 20 and which forms a color image by transferring a plurality of toner images onto a recording material (medium) 10 through an intermediary transfer belt (intermediary transfer member).

A photosensitive drum 1 is an image bearing member (member to be charged) and includes an OPC (organic photoconductor) photosensitive layer formed on an outer peripheral surface of an electroconductive drum and which is rotationally driven in an arrow direction r1 of FIG. 1 at a predetermined process speed by drive transmission thereto from an unshown driving mechanism in the apparatus main assembly.

A charging roller 4 as a charging member electrically charges uniformly a surface of the photosensitive drum 1 to a predetermined polarity and a predetermined potential by being supplied with a charging bias (charging voltage) at predetermined timing. A laser beam scanner 6 as an exposure portion subjects the charged photosensitive drum 1 to scanning exposure (irradiation) to laser light depending on image information, so that an electrostatic latent image is formed on the surface of the photosensitive drum 1.

A developing device as a developing portion develops the electrostatic latent image, formed on the surface of the photosensitive drum 1, with toner as a developer. The developing device is constituted by a developing roller 7, a developing blade 8 and a developing container 9. The developing roller 7 is provided opposed to the photosensitive drum 1 and is a developer carrying member for supplying the toner to the photosensitive drum 1. The developing blade 8 is a regulating member for regulating a layer thickness of the toner carried on the developing roller 7 and for imparting electric charges to the toner. The developing container 9 is a developer accommodating portion for accommodating the toner supplied to the photosensitive drum 1.

The developing roller 7 is rotationally driven in an arrow direction r2 of FIG. 1 by drive transmission from an unshown driving source in the apparatus main assembly. On the surface of the developing roller 7, a toner layer (magnetic chain) to which the electric charges are imparted by the developing blade 8 is formed. Then, to the developing roller 7, a developing bias (developing voltage) in a combination form of a DC voltage and an AC voltage is applied, so that the toner image carried on the developing roller 7 is moved (flown) to the photosensitive drum 1 by an electric field of the developing voltage, and thus the electrostatic latent image formed on the surface of the photosensitive drum 1 is developed into a toner image.

On the other hand, a recording medium 10 is fed by an unshown feeding roller, and in a nip between the photosensitive drum 1 and a transfer roller 11 as a transfer portion, the toner image (developer image) formed on the photosensitive drum 1 is transferred onto the recording medium 10. The recording medium 10 on which the toner image is transferred is separated from the surface of the photosensitive drum 1 and is sent to a fixing device 12, in which the transferred toner image is heated and pressed, and thus is fixed on the recording medium 10.

Toner remaining on the surface of the photosensitive drum 1 without being transferred onto the recording medium 10 is removed by a cleaning blade 2 as a cleaning portion for cleaning the photosensitive drum 1 in contact with the photosensitive drum 1 and is accommodated in a cleaning container 5. Thereafter, the surface of the photosensitive drum 1 is charged again by the charging roller 4, and the above-described steps are repeated, so that a series of image forming cycles is carried out.

In this embodiment (embodiment 1), the photosensitive drum 1, the charging roller 4, the cleaning blade 2, the cleaning container 5, the developing roller 7, the developing blade 8, and the developing container 9 are integrally assembled into the process cartridge 20. Further, the process cartridge 20 is is mountable to and dismountable from the apparatus main assembly M of the image forming apparatus.

<Discharge Detection Constitution between Photosensitive Drum and Developing Roller.

Figure 2:
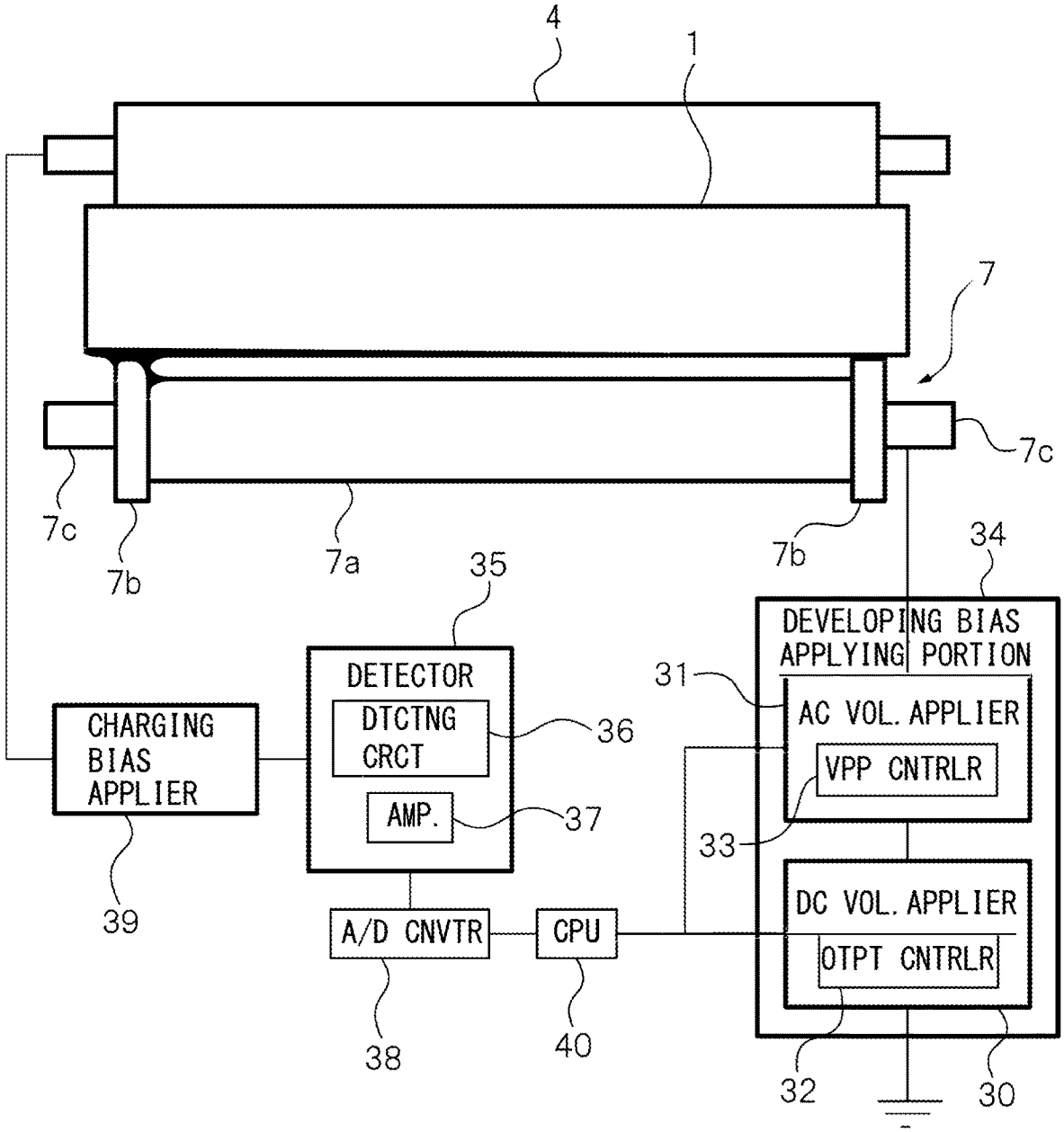
FIG. 2 is a schematic view for illustrating a constitution relating to electric discharge detection between a photosensitive drum and a developing roller.

Next, with reference to FIG. 2, a constitution relating to detection of electric discharge between the photosensitive drum 1 and the developing roller 7 will be described. FIG. 2 is a schematic view for illustrating the constitution relating to the electric discharge detection between the photosensitive drum 1 and the developing roller 7.

As shown in FIG. 2, the developing roller 7 includes a sleeve 7*a* for carrying the toner during image formation, and into opposite end portions of the sleeve 7*a* with respect to a longitudinal direction, circular caps 7*b* are engaged. The developing roller 7 is rotationally driven about a roller shaft 7*c*. In this embodiment, an outer diameter of the photosensitive drum 1 is 30 mm, and an outer diameter of the developing roller 7 is 15 mm smaller than the outer diameter of the photosensitive drum 1, and both the photosensitive drum 1 and the developing roller 7 are rotationally driven at a peripheral speed of 300 mm/s.

Further, the developing roller 7 is provided with a predetermined gap (SD gap) between itself and the photosensitive drum 1 so as to oppose the photosensitive drum 1 in a non-contact state. In the embodiment 1, the caps 7*b* have an outer diameter larger than the sleeve 7*a*, so that outer peripheral surfaces of the caps 7*b* contact the surface of the photosensitive drum 1. By this, the predetermined gap is provided between the developing roller 7 and the photosensitive drum 1, so that the developing roller 7 and the photosensitive drum 1 are opposed to each other in the non-contact state. In this embodiment, as the predetermined gap, the SD gap of 200 μm is provided.

Incidentally, a constitution in which the predetermined gap is provided between the developing roller 7 and the photosensitive drum 1 is not limited thereto. For example, a constitution in which the predetermined gap is provided between the developing roller 7 and the photosensitive drum 1 by a frame rotatably supporting the developing roller 7 and the photosensitive drum 1 may also be employed.

Further, to the roller shaft 7*c* of the developing roller 7, in order to supply the toner to the photosensitive drum 1, a DC voltage applying portion 30 and an AC voltage applying portion 31 are connected. The DC voltage applying portion 30 and the AC voltage applying portion 31 constitute a developing voltage applying portion 34 for applying, to the developing roller 7, a developing voltage in a combination form of a DC voltage and an AC voltage.

The DC voltage applying portion 30 is a circuit for generating a DC component applied to the developing roller 7, and output thereof is inputted to the AC voltage applying portion 31. Further, the DC voltage applying portion 30 includes an output controller 32. The output controller 32 controls a value of a voltage outputted from the DC voltage applying portion 30, depending on an instruction of a CPU 40 as a controller.

Further, the AC voltage applying portion 31 is a circuit for outputting an AC voltage with an average (areal center value) of the DC voltage outputted from the DC voltage applying portion 30. The AC voltage applying portion 31 outputs, for example, an AC voltage in a rectangular waveform shape (pulse shape) including a frequency f=2.5 kHz and a duty of 50%. Further, the AC voltage applying portion 31 includes a Vpp controller 33. The Vpp controller 33 controls Vpp which is a peak-to-peak voltage (peak-to-peak value) of the AC voltage, in accordance with an instruction of the CPU 40 as the controller.

Further, a charging voltage applying portion 39 in an applying portion for applying the charging voltage to the charging roller 4 and is connected to the charging roller 4. A value of the charging voltage applied from the charging voltage applying portion 39 to the charging roller 4 is controlled by the CPU 40 as the controller.

A detecting portion 35 is a detecting portion for detecting a current value of a current flowing between the photosensitive drum 1 and the charging roller 4. The detecting portion 35 is constituted by a detecting circuit 36 and an amplifier 37. The detecting circuit 36 converts the current into a voltage. The amplifier 37 amplifies a converted voltage signal and outputs the amplified voltage signal as a discharge detection signal to the CPU 40. An A/D converter 38 subjects the discharge detection signal from the amplifier 37 to A/D conversion. The CPU 40 recognizes a magnitude of a current value generating between the charging roller 4 and the photosensitive drum 1, on the basis of the output of the amplifier 37 subjected to the A/D conversion by the A/D converter 38, and outputs a current value of the current. Although described later, the CPU 40 is a leakage detecting portion for detecting leak(age) between the photosensitive drum 1 and the developing roller 7 on the basis of the current value detected by the detecting portion 35.

<Detection of Leak(age) Current Value>

Figure 3:
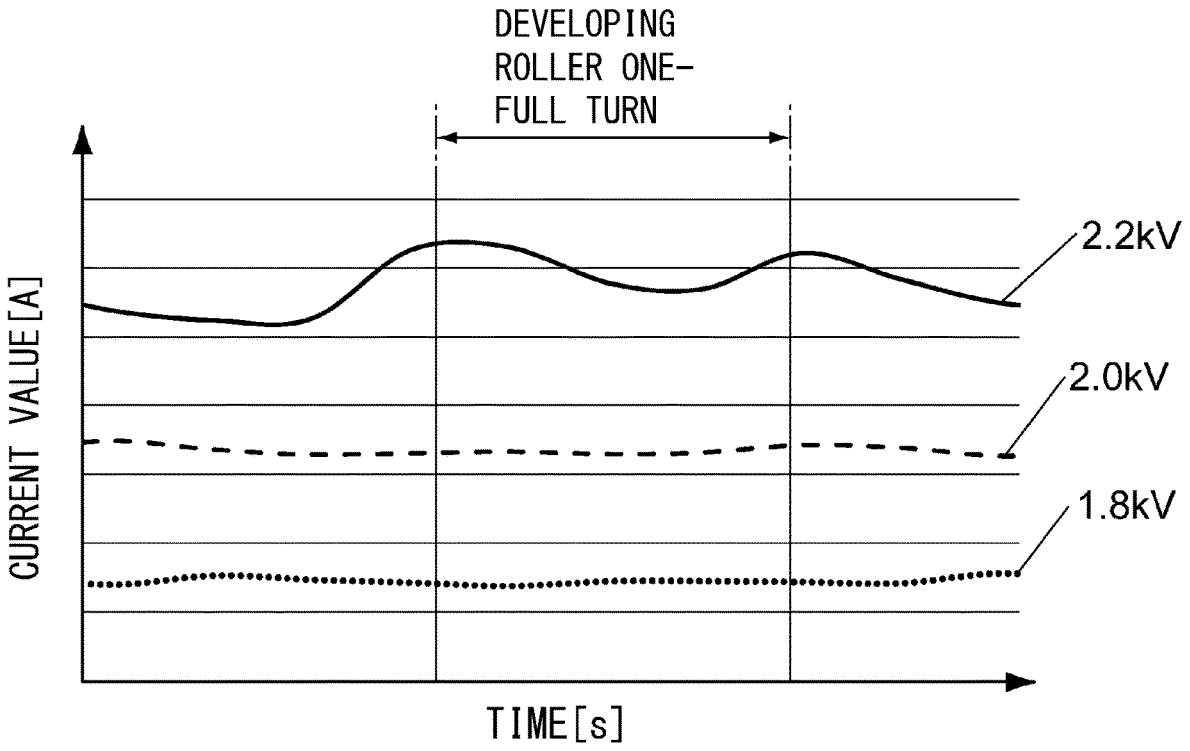
FIG. 3 is a waveform graph (chart) of current values when a peak-to-peak voltage Vpp is changed.

With reference to FIG. 3, detection (electric discharge detection) of a leak current value by the detecting portion 35 will be described. FIG. 3 is a waveform graph of current values when the peak-to-peak voltage Vpp is changed.

In FIG. 3, the current values of currents flowing between the charging roller 4 and the photosensitive drum 1 when the peak-to-peak voltage Vpp of the AC voltage in the developing voltage is changed are plotted, and an abscissa represents a time and an ordinate represents the current value.

As a measuring condition, the photosensitive drum 1 and the developing roller 7 are driven by unshown driving mechanisms. Then, a surface potential of the photosensitive drum 1 is made −500 V by applying a charging voltage to the charging roller 4 by the charging voltage applying portion 39, and a DC voltage of −300 V is applied to the developing roller 7 by the DC voltage applying portion 30. Then, a peak-to-peak voltage Vpp of the AC voltage is applied to the developing roller 7 by the AC voltage applying portion 31. At this time, the peak-to-peak voltage Vpp is increased stepwise from 1600 V by 200 V with a predetermined time interval (1 s in this embodiment), and a relationship between a time in each of the peak-to-peak voltages Vpp and an output value of the current value is plotted. At the AC voltages Vpp up to 2.0 kV, the leak current does not generate, but at the AC voltage Vpp of 2.2 kV, the leak current generates. During non-generation of the leak current, the current value does not flow from the developing roller 7 to the photosensitive drum 1, and therefore, even when the peak-to-peak voltage Vpp changes, at an opposing position between the developing roller 7 and the photosensitive drum 1, a surface potential of the photosensitive drum 1 does not change. The surface potential of the photosensitive drum 1 does not change, and therefore, the current value of the current flowing from the charging roller 4 to the photosensitive drum 1 does not change.

On the other hand, compared with during non-generation of the leak current, during generating of the leak current, the leak current fluctuates at a rotation (cyclic) period of the developing roller 7, so that the current value also increases. During the generation of the leak current, an electric discharge phenomenon occurs between the developing roller 7 and the photosensitive drum 1. By the occurrence of the electric discharge phenomenon between the developing roller 7 and the photosensitive drum 1, the surface potential of the photosensitive drum 1 changes. Then, the charging roller 4 causes the current to flow therethrough so as to uniformize the surface potential of the photosensitive drum 1, and therefore, the current value of the current flowing through between the charging roller 4 and the photosensitive drum 1 also changes.

The reason why the leak current fluctuates at the rotation period of the developing roller 7 is due to that a region where the leak current generates fluctuates at the rotation period of the developing roller 7. The distance (SD gap) between the developing roller 7 and the photosensitive drum 1 fluctuates depending on non-uniformity of a shape of the cap 7*b*.

From the above, the CPU 40 which is the leakage detecting portion detects occurrence or non-occurrence of the leakage between the photosensitive drum 1 and the developing roller 7 at a predetermined AC voltage Vpp from the current value change amount of the current flowing through between the photosensitive drum 1 and the charging roller 4. Detection of the occurrence of the leakage between the photosensitive drum 1 and the developing roller 7 made by using the current value change amount of the current flowing through between the photosensitive drum 1 and the charging roller 4 will be described later in detail.

Incidentally, in the embodiment 1, the constitution in which a transfer voltage is not applied from the transfer roller 11 as a transfer portion to the photosensitive drum 1 when the detection of the leakage is executed was described as an example, but the present invention is not limited thereto. In the constitution of the image forming apparatus shown in FIG. 1, not only the charging roller 4 and the developing roller 7 but also the transfer roller 11 oppose the photosensitive drum 1. For that reason, it would be considered that the surface potential of the photosensitive drum 1 is uniformized by the charging roller 4 at the opposing surface where the photosensitive drum 1 and the charging roller 4 oppose each other and the current flows through an opposing portion where the photosensitive drum 1 opposes the transfer roller 11 after the surface of the photosensitive drum 1 passes through an opposing portion where the photosensitive drum 1 opposes the developing roller 7. In this case, there is a possibility that the surface potential of the photosensitive drum 1 changes at the opposing portion to the transfer roller 11 even when the leakage does not occur between the photosensitive drum 1 and the developing roller 7. Therefore, it is desirable that when the detection of the leakage is carried out, a voltage opposite in polarity to the charging voltage of about several μA in constant current is applied to the transfer roller 11 by a transfer bias (transfer voltage) applying portion (not shown) for applying a transfer voltage to the transfer roller 11. Thus, when the leakage detection is executed, by applying the voltage opposite in polarity to the charging voltage to the transfer roller 11, the surface potential of the photosensitive drum 1 can be stabilized.

Next, with reference to parts (a) and (b) of FIG. 4, a relationship between the peak-to-peak voltage Vpp of the AC voltage and the current value in a comparison example and the embodiment 1 will be described. Part (a) of FIG. 4 is a graph showing a relationship between the peak-to-peak voltage Vpp of the AC voltage and the current value in the comparison example. Part (b) of FIG. 4 is a graph showing a relationship between the peak-to-peak voltage Vpp of the AC voltage and the current value in the embodiment 1. Incidentally, the current value in the comparison example shown in part (a) of FIG. 4 is the current value of the current flowing through between the photosensitive drum 1 and the developing roller 7. On the other hand, the current value in the embodiment 1 shown in part (b) of FIG. 4 is the current value of the current flowing through between the photosensitive drum 1 and the charging roller 4.

In the constitution of the comparison example, an integrated value of an absolute value of the current value of the current flowing between the photosensitive drum 1 and the developing roller 7 in a period of the periodic time T of the AC voltage is the output value. The abscissa represents the peak-to-peak voltage Vpp of the AC voltage, and the ordinate represents the output value.

As a measuring condition, the photosensitive drum 1 and the developing roller 7 are driven by unshown driving mechanisms. Then, a surface potential of the photosensitive drum 1 is made −500 V by applying a charging voltage from the charging voltage applying portion 39 to the charging roller 4, and a DC voltage of −300 V is applied to the developing roller 7 by the DC voltage applying portion 30. Then, a peak-to-peak voltage Vpp of the AC voltage is applied to the developing roller 7 by the AC voltage applying portion 31. At this time, the peak-to-peak voltage Vpp is increased gradually, and a relationship between the peak-to-peak voltage Vpp and the output value of the current value is plotted. In part (a) of FIG. 4, it is understood that even when the applied voltage is less than the discharge start voltage Vpp, the output value which is the current value between the photosensitive drum 1 and the developing roller 7 increases in proportion to the peak-to-peak voltage Vpp.

A slope of the output value at the peak-to-peak voltage Vpp which is the discharge start voltage or less is determined by impedance between the photosensitive drum 1 and the developing roller 7 and therefore changes depending on the SD gap or the like. For that reason, the output value varies depending on variation in component part of the cap 7*b* and abrasion due to durable use of the cap 7*b*. Therefore, a current value at which the leakage occurs cannot be accurately calculated when the SD gap fluctuates due to abrasion and variation in component part of the cap 7*b* in a use status. In order to discriminate the occurrence of the leakage with accuracy, there is a need to acquire the impedance between the photosensitive drum 1 and the developing roller 7 by using the peak-to-peak voltage Vpp at which the leakage does not occur. For detection of the leakage, there is a need to measure the impedance at the peak-to-peak voltage Vpp at which the leakage does not occur, and therefore, it takes much time to detect the occurrence of the leakage.

On the other hand, in the constitution of the embodiment 1, discrimination of the occurrence or non-occurrence of the leakage between the photosensitive drum 1 and the developing roller 7 is made on the basis of the current value change amount between the charging roller 4 and the photosensitive drum 1 before and after the voltage Vpp is applied.

As shown in part (b) of FIG. 4, it is understood that the current value of the current flowing through between the photosensitive drum 1 and the charging roller 4 is substantially unchanged at the voltage which is less than the discharge start voltage Vpp by the influence of the voltage Vpp. Further, it is understood that the current value of the current flowing through between the photosensitive drum 1 and the charging roller 4 abruptly increases when the peak-to-peak voltage Vpp is the discharge start voltage Vpp or more. That is, the occurrence or non-occurrence of the leakage can be discriminated on the basis of the current value change amount of the current flowing through between the photosensitive drum 1 and the charging roller 4.

During the execution of the detection of the leakage, in the case where there is no change in surface potential of the photosensitive drum 1 between the charging roller 7 and the charging roller 4 with respect to the rotational direction of the photosensitive drum 1, the occurrence or non-occurrence of the leakage can be discriminated from the change in current value of the current flowing through between the photosensitive drum 1 and the charging roller 4. For example, in the image forming apparatus having the constitution shown in FIG. 1, in the case where during the execution of the leakage detection, the voltage opposite in polarity to the charging voltage is properly applied to the transfer roller 11, it is possible to discriminate the occurrence or non-occurrence of the leakage on the basis of the current value change amount of the current flowing through between the photosensitive drum 1 and the charging roller 4.

However, in the image forming apparatus having the constitution shown in FIG. 1, there is a need to consider a constitution in which during the execution of the leakage detection, the above-described voltage is not applied to the transfer roller 11 opposing the photosensitive drum 1 between the developing roller 7 and the charging roller 4 with respect to the rotational direction of the photosensitive drum 1. That is, there is a need to consider a constitution exerting a change on the surface potential of the photosensitive drum 1 between the developing roller 7 and the charging roller 4 with respect to the rotational direction of the photosensitive drum 1.

For that reason, in the embodiment 1, as described above, discrimination of the occurrence or non-occurrence of the leakage between the photosensitive drum 1 and the developing roller 7 is made using a change amount between a current value of the current flowing from the charging roller 4 to the photosensitive drum 1 before application of the developing voltage and a current value of the current flowing from the charging roller 4 to the photosensitive drum 1 after the application of the developing voltage. For this reason, in this embodiment, without measuring the impedance between the photosensitive drum 1 and the developing roller 7, the occurrence or non-occurrence of the leakage at an arbitrary applied voltage can be determined, so that a detection time required for detecting the occurrence of the leakage can be shortened.

<Setting of AC Voltage in Discharge Occurrence Detecting Operation>

Next, on the basis of parts (a) and (b) of FIG. 5, timing of each of applied voltages during a discharge detecting operation of the image forming apparatus according to the embodiment 1 will be described in comparison with the comparison example. Part (a) of FIG. 5 is a timing chart as to setting of the AC voltage Vpp during detection of discharge occurrence and the leak current in the comparison example. Part (b) of FIG. 5 is a timing chart as the setting of the AC voltage Vpp during detection of discharge occurrence and the leak current in the embodiment 1.

Part (a) of FIG. 5 shows the constitution of the comparison example, and part (b) of FIG. 5 shows the constitution of the embodiment 1. In order to detect the occurrence or non-occurrence of the leakage, in the constitution of the comparison example shown in part (a) of FIG. 5, compared with the constitution of the embodiment 1 shown in part (b) of FIG. 5, first, a measuring time for measuring the impedance between the photosensitive drum 1 and the developing roller 7 is needed. The impedance between the photosensitive drum 1 and the developing roller 7 changes depending on the fluctuation of the SD gap by the drive of the photosensitive drum 1 and the developing roller 7. For that reason, in the period of the time T2 in which the photosensitive drum 1 rotates through one full circumference, the current value of the current flowing through between the photosensitive drum 1 and the developing roller 7 is measured, and then the impedance is acquired by using a current value which is the maximum value at a timing when the SD gap is narrowest. A subsequent operation will be described with reference to part (b) of FIG. 5 since the setting of the voltage Vpp and the timing are similar to those in the embodiment 1.

The voltage Vpp during the discharge occurrence detecting operation is determined on the basis of the voltage Vpp during the image formation. As regards the voltage Vpp during the image formation, as initial setting, the voltage Vpp is set at 1.8 kV. When the voltage Vpp exceeds 1.8 kV, fog on a white background portion of the recording medium 10 worsens, and therefore, an upper limit of the voltage Vpp is set at 1.8 kV.

As regards the voltage Vpp during the detection of the discharge occurrence, in consideration that the discharge start voltage changes depending on a change in temperature and humidity during sheet passing and the fluctuation of the SD gap, the voltage Vpp during an initial discharge occurrence detecting operation is set at 2.0 kV obtained by adding an offset value of 200 V to 1.8 kV which is the voltage during the image formation. That is, the AC voltage Vpp applied to the developing roller 7 when the leakage detection is made is an AC voltage (2.0 kV in this embodiment) which is higher than the AC voltage (1.8 kV in this embodiment) applied to the developing roller 7 during the image formation. In the case where the CPU 40 discriminated that the leakage between the photosensitive drum 1 and the developing roller 7 does not occur, on the basis of the output value of the current value when the voltage Vpp during the initial discharge occurrence detection is set at 2.0 kV, the CPU 40 does not change the voltage Vpp during image formation. On the other hand, in the case where the CPU 40 discriminated that the leakage between the photosensitive drum 1 and the developing roller 7 occurs, as shown in part (b) of FIG. 5, the AC voltage Vpp applied to the developing roller 7 is lowered stepwise to the voltage Vpp at which the leakage detecting portion detected that the leakage does not occur. Then, the voltage Vpp obtained by subtracting the offset value of 200 V from the voltage Vpp at which the leakage detecting portion detected that the leakage does not occur is set again at the (applied) voltage Vpp during the image formation. By this, it is possible to prevent occurrence of the leakage between the photosensitive drum 1 and the developing roller 7 during the image formation.

Further, as in the embodiment 1, by employing the constitution in which the voltage Vpp during detection of the discharge occurrence is lowered stepwise, compared with the conventional control of acquiring the discharge start voltage by increasing the voltage Vpp, a detection time required for detecting the occurrence of the leakage can be shortened. As a reason therefor, in the constitution of the embodiment 1 in which the voltage Vpp is lowered stepwise, detection is ended at the time when discrimination that the leakage does not occur at the voltage Vpp as the initial condition during leak detection was made. For that reason, in the constitution of the embodiment 1, the leakage detection is ended at the voltage Vpp as a single condition in the shortest time. On the other hand, in the conventional constitution in which the voltage Vpp is gradually increased, the voltage Vpp is gradually increased from the voltage Vpp at which the leakage does not generate with reliability. For that reason, in the conventional constitution, there is a need that the leakage detection is carried out at voltages Vpp falling under at least two conditions including the voltage Vpp at which the leakage does not occur with reliability and the voltage Vpp intended to be used in the image formation. From the above, by employing the constitution in which the voltage Vpp during the detection of the discharge occurrence is lowered stepwise, compared with the constitution in which the voltage Vpp is gradually increased, the detection time required for detecting the occurrence of the leakage can be shortened.

Further, in the constitution of the embodiment 1, the voltage Vpp at which the leakage does not occur with reliability on the basis of the gap between the photosensitive drum 1 and the developing roller 7 is stored in an unshown memory in advance, and then the voltage Vpp may also be directly lowered from the voltage Vpp at which the leakage occurred to the voltage Vpp at which the leakage does not occur with reliability. By doing so, the leakage detection is ended at the voltage Vpp as a single condition even in the case where the number of conditions is largest. This is because there is no need to carry out the leakage detection at the voltage Vpp at which the leakage does not occur with reliability.

<Flowchart of Discharge Occurrence Detecting Operation>

Next, with reference to FIG. 6, a flow of control of the discharge occurrence detecting operation of the image forming apparatus according to the embodiment 1 will be described.

FIG. 6 is a flow chart showing an example of the flow of the control of the discharge occurrence detecting operation of the image forming apparatus according to the embodiment 1. The discharge occurrence detecting operation described below, in which occurrence or non-occurrence of the leakage between the photosensitive drum 1 and the developing roller 7 is detected, is executed by the CPU 40 (FIG. 2), which is the leakage detecting portion. Incidentally, this discharge occurrence detecting operation is executed when an installation environment of the image forming apparatus, such as atmospheric pressure, a temperature or a humidity, changes. Alternatively, the discharge occurrence detecting operation is executed in synchronism with a driving time of the developing roller 7 or the photosensitive drum 1 (for example, sheet passing history or exchange timing of the developing device for which there is a possibility that the SD gap changes). Further, execution timing of the discharge occurrence detecting operation is not limited to the above-described examples, but can be appropriately set. However, in this embodiment, the discharge occurrence detecting operation is performed during non-image formation.

First, when a power source of the image forming apparatus is turned on and the discharge occurrence detecting operation is started ("START"), by an instruction of the CPU 40, drive of rotatable members such as the photosensitive drum 1 and the developing roller 7 is started by the unshown driving mechanisms (step S1). This drive of each of the rotatable members is continued until the discharge occurrence detecting operation is ended. Then, a charging voltage is applied to the charging roller 4 by the charging voltage applying portion 39, and a DC voltage of −300 V is applied to the developing roller 7 by the DC voltage applying portion 30 (step S2). From the step S2, the time (T2) in which the photosensitive drum 1 rotates through one full circumference elapsed (step S3), so that the surface potential of the photosensitive drum 1 becomes −500 V over a full circumference. Then, the AC voltage Vpp applied to the developing roller 7 is set. In consideration of a change in temperature and humidity during sheet passing and a fluctuation in SD gap, the AC voltage Vpp applied to the developing roller 7 is set at an AC voltage Vpp higher than the AC voltage Vpp in setting during image formation by an offset value (step S4). In this embodiment, the AC voltage Vpp applied to the developing roller 7 is set at an AC voltage Vpp 200 V higher than the AC voltage Vpp during image formation. Then, as described above with reference to part (b) of FIG. 4, the CPU 40 discriminates whether or not the current value change amount of the current flowing between the photosensitive drum 1 and the charging roller 4 is not less than the threshold which is the predetermined value (step S5). Here, the current value is the change amount between the current value of the current flowing through between the photosensitive drum 1 and the charging roller 4 before the above-set AC voltage Vpp is applied to the developing roller 7 and the current value of the current value flowing through between the photosensitive drum 1 and the charging roller 4 after the above-set AC voltage Vpp is applied to the developing roller 7. Specifically, the former current is a voltage detected by the detecting portion 35 when the surface of the photosensitive drum 1 opposing the developing roller 7 before application of the developing voltage passes through the charging roller 4. The latter current value is a current value detected by the detecting portion 35 when the surface of the photosensitive drum 1 opposing the developing roller 7 after the application of the developing voltage passes through the charging roller 4. In the step S5, whether or not the change amount between the former current value and the latter current value is the threshold or more is determined. In this embodiment, the threshold is 1 μA.

Then, in the case where the current value change amount is the threshold or more in the step S5, the leakage generates between the photosensitive drum 1 and the developing roller 7, and therefore, the CPU 40 puts the AC voltage Vpp of the developing voltage in an OFF state (step S6). Thus, in the case where the leakage occurs, setting of the AC voltage Vpp applied to the developing roller 7 during image formation is lowered to a voltage smaller than present setting (step S7). In this embodiment, the CPU 40 lowers the AC voltage to a voltage (for example, 1.7 kV) 100 V lower than the AC voltage (for example, 1.8 kV) during image formation. Then, the operation returns to the step S4, the AC voltage applied to the developing roller 7 is set at an AC voltage Vpp higher than a setting-changed AC voltage during image formation by the offset value. Thus, the AC voltage applied to the developing roller 7 during leak detection is lowered from 2.0 kV to 1.9 kV. Then, in the step S5, whether or not the current value change amount is the threshold or more is checked again.

Incidentally, in the case where the current value change amount is the threshold or more in the step S5, the CPU 40 lowers stepwise the AC voltage applied to the developing roller 7 during leak detection, and repeats the above-described operation until the current value change amount is less than the threshold. That is, in the case where the CPU which is the leakage detecting portion detected in the step S5 that the leakage occurred, the CPU 40 lowers stepwise the AC voltage applied to the developing roller 7 and then detects the leakage between the photosensitive drum 1 and the developing roller 7.

In the case where the current value change amount is less than the threshold in the step S5, the CPU 40 repeats the operation in the step S5 in a period of the time T2 in which the photosensitive drum 1 rotates through one full circumference from the application of the charging voltage to the charging roller 4 (step S8). In the case where the current value change amount is less than the threshold in the period, the CPU 40 determines that a value lowered from the AC voltage Vpp at that time during leak detection by the offset value (200 V) is the AC voltage Vpp during image formation (step S9). Then, the CPU 40 puts the developing voltage and the charging voltage in an OFF state, and thereafter, causes the driving mechanisms to stop the drive of the photosensitive drum 1 and the developing roller 7 (step S10), so that the CPU 40 ends the discharge occurrence detecting operation ("END").

From the above, according to the embodiment 1, by discriminating occurrence or non-occurrence of the leakage from the current value change amount of the current flowing through between the photosensitive drum 1 and the developing roller 7, it is possible to shorten the detection time required for detecting the occurrence or non-occurrence of the leakage between the photosensitive drum 1 and the developing roller 7.

Further, according to the embodiment 1, the occurrence or non-occurrence of the leakage is detected from the change in current value between the photosensitive drum 1 and the charging roller 4, and therefore, compared with the constitution in which the occurrence or non-occurrence of the leakage is detected from the current value between the photosensitive drum 1 and the developing roller 7, it is possible to detect slight leakage. In the following, the reason therefor will be described. When the AC voltage is applied to the developing roller 7 during the leakage detection, a state in which the current always flows from the developing roller 7 to the ground is formed. For that reason, even when the leakage occurs between the photosensitive drum 1 and the developing roller 7, a value obtained by adding a current value of the current flowing from the developing roller 7 to the ground to a current value of the current flowing between the photosensitive drum 1 and the developing roller 7 due to the leakage is a current value detected by the detecting portion. On the other hand, according to the embodiment 1, even when the AC voltage is applied to the developing roller 7, unless the surface potential of the photosensitive drum 1 changes from the position of the developing roller 7 to the position of the charging roller 4, the current does not flow from the charging roller 4 to the photosensitive drum 1. Therefore, according to the embodiment 1, it is possible to eliminate the influence of grounding current at the developing portion and, therefore, it is possible to detect even slight leakage.

Further, according to the embodiment 1, discrimination of the occurrence or non-occurrence of the leakage between the photosensitive drum 1 and the developing roller 7 is made by using the change amount between the current value of the current flowing from the charging roller 4 to the photosensitive drum 1 before the application of the developing voltage and the current value of the current flowing from the charging roller 4 to the photosensitive drum 1 after the application of the developing voltage. For this reason, even in the constitution in which the surface potential of the photosensitive drum changes between the developing roller 7 and the charging roller 4 with respect to the rotational direction, the occurrence or non-occurrence of the leakage can be suitably detected. Different from the comparison example, without measuring the impedance between the photosensitive drum 1 and the developing roller 7, it is possible to detect the occurrence or non-occurrence of the leakage at an arbitrary applied voltage, and it is possible to shorten the detection time required for detecting the occurrence of the leakage.

Incidentally, in the case where there is no constitution in which the surface potential of the photosensitive drum 1 changes between the developing roller 7 and the charging roller 4, without using the current value change amount before and after the application of the developing voltage, the occurrence or non-occurrence of the leakage can be discriminated from comparison between the current value and the threshold.

Incidentally, the SD gap, the charging voltage, the developing voltage, the threshold of the current value, and the like described in the embodiment 1 are not intended to be limited to those described herein unless otherwise specified.

Further, in the embodiment 1, the contact charging type in which the charging roller 4 is contacted to the photosensitive drum 1 was used, but when a constitution in which the charging current can be detected is employed, a non-contact charging type may also be used.

Further, in the embodiment 1, the constitution in which the detection of the leakage using the current value change amount is made in the period of the time in which the photosensitive drum 1 rotates through one full circumference was described as an example, but the period in which the detection of the leakage is made is not limited thereto. The period may also be a time in which the photosensitive drum 1 rotates through a plurality of full circumferences or a time in which the developing roller 7 rotates. However, the distance (SD gap) between the photosensitive drum 1 and the developing roller 7 fluctuates in a rotation period (cyclic period) of the developing roller 7 and the photosensitive drum 1, and therefore, of the developing roller 7 and the photosensitive drum 1, the member of which one full turn time is longer may preferably be rotated. Further, for the purpose of shortening the detection time, the time in which the developing roller 7 or the photosensitive drum 1 is rotated may preferably be short.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-035465 filed on Mar. 3, 2020, which is hereby incorporated by reference herein in its entirety.

What is claimed is:

1. An image forming apparatus comprising:

a rotatable image bearing member;

a charging member configured to electrically charge a surface of said image bearing member;

a charging voltage applying portion configured to apply a charging voltage to said charging member;

a developer carrying member provided opposed to said image bearing member in non-contact with said image bearing member and configured to carry a developer;

a developing voltage applying portion configured to apply, to said developer carrying member, a developing voltage in a combination form of a DC voltage and an AC voltage;

a detecting portion configured to detect a current value of a current flowing between said image bearing member and said charging member; and a controller configured to control said detecting portion so as to detect the current value of the current, wherein in a state in which the charging voltage is applied to said charging member, said controller controls said detecting portion so as to detect whether or not a change amount between a current value detected by said detecting portion when the surface of said image bearing member opposing said developer carrying member before application of said developing voltage passes through an opposing portion where said charging member and said image bearing member are opposed to each other and a current value detected by said detecting portion when the surface of said image bearing member opposing said developer carrying member after the application of said developing voltage passes through the opposing portion is a threshold or more.

2. An image forming apparatus according to claim 1, further comprising a leakage detecting portion configured to detect that leakage occurs between said image bearing member and said developer carrying member, wherein said leakage detecting portion detects that the leakage occurs between said image bearing member and said developer carrying member in a case that a change amount between a current value detected by said detecting portion before application of the AC voltage and a current value detected by said detecting portion after the application of the AC voltage is the threshold or more.

3. An image forming apparatus according to claim 2, wherein in a time in which said developer carrying member or said image bearing member rotates through at least one full circumference, in a case that the change amount between the current value detected by said detecting portion before the application of said developing voltage and the current value detected by said detecting portion after the application of said developing voltage is less than the threshold, said leakage detecting portion detects that the leakage does not occur.

4. An image forming apparatus according to claim 2, wherein in a case that said leakage detecting portion detects that the leakage occurs, the AC voltage applied to said developer carrying member is stepwisely lowered and said leakage detecting portion detects an AC voltage at which the leakage does not occur between said image bearing member and said developer carrying member.

5. An image forming apparatus according to claim 2, wherein when detection of the leakage is executed, the AC voltage applied to said developer carrying member is higher than an AC voltage of a developing voltage applied to said developer carrying member during image formation.

6. An image forming apparatus according to claim 2, further comprising:

a transfer portion configured to transfer a toner image onto a recording material from said image bearing member on which an electrostatic image is developed into the toner image; and a transfer voltage applying portion configured to apply a transfer voltage to said transfer portion, wherein when said leakage detecting portion executes detection of the leakage, said leakage detecting portion causes said transfer voltage applying portion to apply a voltage opposite in polarity to the charging voltage to said transfer portion.

7. An image forming apparatus according to claim 2, wherein said leakage detecting portion executes detection of the leakage at a driving time of said developer carrying member or said image bearing member.

8. An image forming apparatus according to claim 2, wherein said leakage detecting portion executes detection of the leakage at a time when a temperature, a humidity or an atmospheric pressure changes.

9. An image forming apparatus according to claim 2, wherein in a case that said leakage detecting portion executes detection of the leakage, said leakage detecting portion causes one of said developer carrying member and said image bearing member to rotate through at least one full circumference, the one of said developer carrying member and said image bearing member caused to rotate through at least one full circumference having a longer time of rotation through one full circumference than that of the other one of said developer carrying member and said image bearing member.

* * * * *